US005720221A

United States Patent [19]

Harig et al.

[11] Patent Number: 5,720,221

[45] Date of Patent: Feb. 24, 1998

[54] ASSEMBLY FOR CONTROLLING THE TEMPERATURE OF A FOUNTAIN FLUID AND/OR SELECTED DRUMS OF A PRINTING MACHINE

[75] Inventors: Andreas Harig, Augustdorf; Martin Prummer, Hasbergen, both of Germany

[73] Assignee: Technotrans GmbH, Sassenberg, Germany

[21] Appl. No.: 842,083

[22] Filed: Apr. 28, 1997

[30] Foreign Application Priority Data

May 3, 1996 [DE] Germany ..... 29608045.4

[51] Int. Cl.[6] ..... B41F 31/06; B41F 7/37; B41F 13/22

[52] U.S. Cl. ..... 101/148; 101/350.1; 101/487

[58] Field of Search ..... 101/349.1, 350.1, 101/350.5, 207, 208, 209, 210, 148, 147, 363, 364, 366, 487, 488; 210/175; 62/903, 904, 113; 165/6, 299

[56] References Cited

U.S. PATENT DOCUMENTS 5,272,971 12/1993 Fredericks ..... 101/136
5,611,278 3/1997 Garner et al. ..... 101/208

*Primary Examiner*—J. Reed Fisher
*Attorney, Agent, or Firm*—Griffin, Butler, Whisenhunt & Kurtossy

[57] ABSTRACT

An assembly for controlling the temperature of a fountain fluid and/or selected drums of a printing machine comprises a fountain fluid circulating system for supplying a fountain fluid application means with a fountain fluid, a cooling fluid circulating system for supplying a drum cooling means with a cooling fluid, a first internal cold source which is in heat-exchanging relationship with the fountain fluid circulating system, a second external cold source which is in heat-exchanging relationship with the cooling fluid circulating system, and a means for selectively operating one of the circulating systems, for the fountain fluid or the cooling fluid, or both of these circulating systems. Further the condenser means of the first cold source is in heat-exchanging relationship with the refrigerant circulating system of the second cold source. The temperature controlling assembly thereby allows the requirements for cooling energy to be precisely matched to the currently effective operational mode.

3 Claims, 1 Drawing Sheet

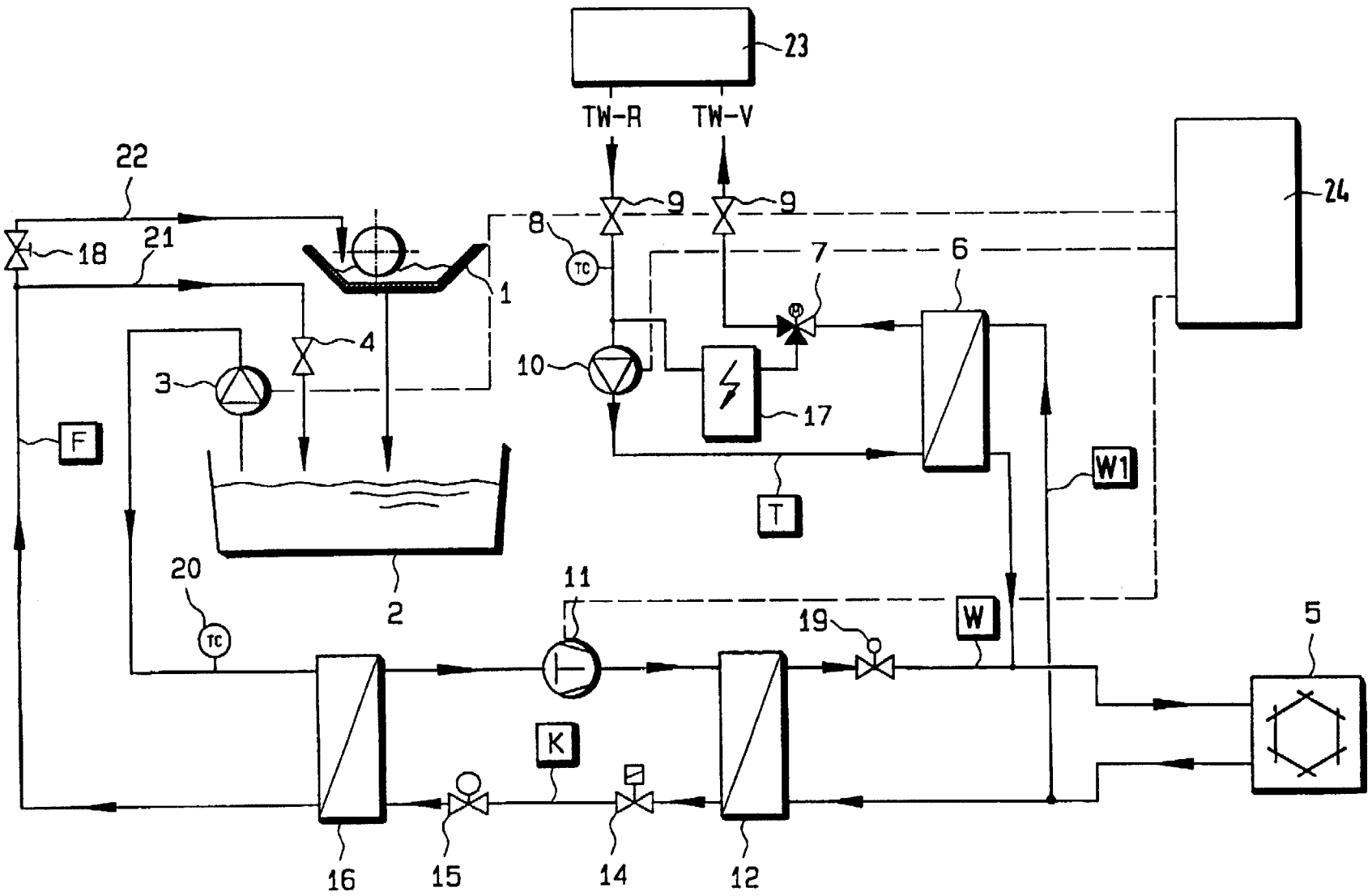
24
5
W1
6
W
7
17
T
19
23
TW-V
9
TW-R
9
12
14
11
K
8
10
1
15
2
4
16
3
20
22
21
18
F

ASSEMBLY FOR CONTROLLING THE TEMPERATURE OF A FOUNTAIN FLUID AND/OR SELECTED DRUMS OF A PRINTING MACHINE

BACKGROUND OF THE INVENTION

The invention relates to an assembly for controlling the temperature of a fountain fluid and/or selected drums of a printing machine. The invention relates in particular to a compact equipment for offset printing machines which may be constructed in the form of a cabinet for example and which makes it possible to supply a damping unit of a printing machine independently with a conditioned fountain fluid and an inking unit with a cooling fluid for controlling the temperature therof.

DESCRIPTION OF THE PRIOR ART

Up to now, for controlling the temperature of an inking unit and for cooling a damping unit the tendency has been to provide separate cooling units, thereby these units had to be appropriately designed for the cold energy requirements and the differing temperatures of the particular devices that needed cooling, this thereby presenting disadvantages as regards the energy consumption and also the operating and installation costs vis a vis integrated equipments including only one cooling unit, such as is known e.g. from DE-B-295 20 464. The single cooling unit caters for the cooling of both the damping unit and the inking unit, whereby both systems can nevertheless be operated independently of one another. However, the single cooling unit had to be dimensioned so as to be in accord with the total cold energy requirements of the equipment, although in a number of operational modes a lower amount of cold energy would be sufficient which deteriorates the energy balance correspondingly.

An object of the invention is to develop a temperature controlling assembly of the type mentioned hereinabove which enables a more satisfactory energy balance to be obtained by matching the cold energy requirements more objectively to the current operational mode of the assembly.

SUMMARY OF THE INVENTION

This object is achieved in accordance with the present invention by an assembly for controlling the temperature of a fountain fluid and/or selected drums of a printing machine including a fountain fluid circulating system for supplying a fountain fluid application means with a fountain fluid, a cooling fluid circulating system for supplying a drum cooling means with a cooling fluid, a first cold source which is in heat-exchanging relationship with the fountain fluid circulating system and which comprises a condenser means and a first refrigerant circulating system, a second cold source which is in heat-exchanging relationship with the cooling fluid circulating system and which comprises a second refrigerant circulating system, and a means for selectively operating one of the circulating systems, for the fountain fluid or the cooling fluid, or both of these circulating systems, wherein the condenser means of the first cold source is in heat-exchanging relationship with the second refrigerant circulating system of the second cold source.

The invention represents an intermediate stage between a temperature controlling assembly including independent cooling units and one such as has only a single cooling unit, this being more advantageous for some fields of application, wherein, although two cold sources are provided in accordance with the invention, these are nevertheless in a heat-exchanging relationship with one another so that the more powerful cold source can be designed in dependence on the, in terms of energy, more propitious cold source, such as is required for cooling the rolls of the inking unit. The second, less powerful cold source cools the fountain fluid down to a lower temperature level with the support of the first cold source. That particular cold source, which is primarily associated with the cooling of the fountain fluid, can therefore be dimensioned to be comparatively weaker so that it is suitable for being accommodated in a compact equipment cabinet, whereas, in the case of the other cold source, this could preferably be an external cold source e.g. an external water cooling system appertaining to the works. The invention offers particular advantages when an external cooling system of this type is available at the place where the temperature controlling assembly is to be installed and can be utilised for the purposes in accordance with the invention. The invention thereby makes it possible for the circulating systems for the cooling of the fountain fluid and for the cooling of the drums to operate independently of one another so that a free choice of operational mode can be made.

BRIEF DESCRIPTION OF THE DRAWING

The invention will be explained in more detail hereinafter with reference to the drawing which shows the flow pattern diagram of a temperature controlling assembly in accordance with a preferred embodiment of the invention.

DETAILED DESCRIPTION OF THE PREFERRED EMBODIMENT

The temperature controlling assembly in accordance with the present invention comprises the following, basically mutually independent fluid circulating systems: a fountain fluid circulating system F, a cooling fluid circulating system T, a first refrigerant circulating system K including a first cold source and a second refrigerant circulating system W including a second cold source 5.

The fountain fluid circulating system F, which is preferably an open system, may supply a damping unit, which is indicated by 1, of a printing machine (not shown) with a fountain fluid from a storage container 2. A pump 3 is provided for pumping the fountain fluid from the storage container 2 to the damping unit 1 via a first heat-exchanging means 16 and a supply line 22. The fountain fluid flows back freely from the damping unit 1 into the storage container 2. An adjustment in the quantity of fountain fluid that is supplied to the damping unit 1, can be effected by means of a by-pass line 21 and an adjustable by-pass valve 4. Furthermore, the storage container 2 serves as a buffer store for the fountain fluid circulating system F. A further blocking valve in the by-pass line 21 is indicated by the reference numeral 18. The temperature of the fountain fluid circulating in the circulating system F can be determined by means of a temperature sensor 20 provided on the up-stream side of the first heat-exchanging means 16 in order to control the refrigerant circulating system K, in a manner corresponding to the cold energy requirements of the circulating system F, such as to maintain the fountain fluid at a suitable temperature.

The cooling fluid circulating system T is preferably a closed system and comprises a pump 10 for circulating a cooling fluid through a second heat-exchanging means 6 and a drum cooling means 23 which can be supplied with the cooling fluid by means of respective supply pipelines TW-V and TW-R which are each provided with a respective blocking valve 9. A heating means 17, which may be a continuous heater, is provided in a by-pass line that is in parallel with the second heat-exchanging means 6. A three-way valve 7, which is provided in the cooling fluid circulating system T on the up-stream side of the second heat-exchanging means 6, enables the cooling fluid to circulate, by-passing the second heat-exchanging means 6, in that the cooling fluid is led through the heating means 17 in order to control the temperature of the cooling fluid when desired. A temperature sensor 8 in the return flow supply pipeline TW-R for the drum cooling means 23 serves to control the position of the three-way valve 7 in accordance with the cold energy requirements of the drum cooling means 23.

The basic construction of the circulating systems F and T for the fountain fluid and the cooling fluid is known to a person skilled in the art and does not need to be explained in detail here. The basic construction of the damping unit 1 and of the drum cooling means 23 is likewise known and, for the same reasons, does not require a more detailed explanation.

In the down-stream direction, the first refrigerant circulating system K comprises, in succession, a compressor 11, a condenser means 12, a controlling valve 14, which is preferably a magnetic valve, and an expansion valve 15 which together form a first cold source. In addition, the first refrigerant circulating system K comprises the first heat-exchanging means 16 for enabling a heat-exchange to occur between the refrigerant of the first refrigerant circulating system K and the fountain fluid of the fountain fluid circulating system F.

In accordance with the present invention, the condenser means 12 of the first cold source is in heat-exchanging relationship with a refrigerant e.g. water of the second refrigerant circulating system W which, for its part, can be supplied with cold energy from the external or second cold source 5. Consequently, the condenser means 12 is constructed in the form of a heat-exchanging means through which the refrigerant from the first cold source as well as the refrigerant from the second refrigerant circulating system W can flow. In the case of the second cold source 5, this may be an external cooling water network e.g. a cooling tower installation or a cooling unit preferably including a glycol recooling means (not shown).

A parallel supply line W1 is branched off from the second refrigerant circulating system W in order to lead the refrigerant to the second heat-exchanging means 6 so as to provide for a heat-exchange of the second refrigerant with the cooling fluid of the cooling fluid circulating system T for the drum cooling means 23. The quantity of second refrigerant, which is supplied to the condenser means 12, is controllable by means of a valve 19 which is provided in a line of the second refrigerant circulating system W on the down-stream side of the condenser means 12 and on the up-stream side of a return section of the supply line W1.

One feature of the temperature controlling assembly in accordance with the present invention is that the condenser means 12 of the first cold source, which comprises the first refrigerant circulating system K, is in heat-exchanging relationship with the second cold source 5 via the second refrigerant circulating system W.

The temperature controlling assembly constructed as hereinbefore described works as follows.

1. Operational mode "Cooling of only the fountain fluid"

In the case of this operational mode, the circulating system T is made inoperative in that the pump 10 is switched off by virtue of a command from a control means 24. By contrast, the first cold source of the first refrigerant circulating system K is operative and supplies the first heat-exchanging means 16 with cold energy in order to cool the fountain fluid flowing through the first heat-exchanging means 16 in an appropriate manner. The waste heat from the first cold source is supplied via the condenser means 12 to the refrigerant of the second refrigerant circulating system W so that the efficiency of the first cold source is increased accordingly. The pump 3 of the fountain fluid circulating system F transports the cooled fountain fluid from the storage container 2 to the damping unit 1 in dependence on the temperatures measured by the sensor 20.

2. Operational mode "Cooling of only the inking unit"

The fountain fluid circulating system F is switched off in that the pump 3 is switched off by virtue of a command from the control means 24 and, furthermore, in that the first cold source comprising the compressor 11, the controlling valve 14, the expansion valve 15 and the condenser means 12 is made inoperative. By contrast, the pump 10 of the cooling fluid circulating system T is made operative in order to set the cooling fluid in circulation and to control the temperature of the cooling fluid in that, in dependence on the position of the three-way valve 7 controlled by the temperature sensor 8, more, or less cooling fluid is led through the second heat-exchanging means 6 for heat-exchange with the refrigerant of the refrigerant circulating system W of the second cold source 5.

The additional heating means 17 provided in the cooling fluid circulating system T is switched-on in the event that the temperature of the cooling fluid should fall below a lower threshold value which falls outside the controlling range of the aforementioned control means.

3. Operational mode "Cooling of the fountain fluid and cooling of the inking unit"

This operational mode represents a combination of the previously described operational modes in that all of the circulating systems F, K, T and W are made operative and cold energy is applied from both the first cold source and the second cold source 5. The control of the temperature of the fountain fluid of the fountain fluid circulating system F and of the cooling fluid of the cooling fluid circulating system T can occur, mutually independently, in the manner previously described.

As a result of the combination of an external cold source 5 with an internal cold source comprising the compressor 11, the controlling valve 14, the expansion valve 15 and the condenser means 12, the energy requirements for the temperature controlling assembly are substantially lower than when both circulating systems F and T are supplied by a single, large-dimensioned cold source which has to be designed for the lowest required temperature. In the case of the invention, the first cold source has to be designed for a higher temperature level which is more propitious in terms of energy, whereby a second less powerful cold source is drawn upon when needed in order to cool the fountain fluid down to a desired low temperature level.

We claim:

1. Assembly for controlling the temperature of a fountain fluid and/or selected drums of a printing machine including a fountain fluid circulating system for supplying a fountain fluid application means with a fountain fluid, a cooling fluid circulating system for supplying a drum cooling means with a cooling fluid, a first cold source which is in heat-exchanging relationship with the fountain fluid circulating system and which comprises a condenser means and a first refrigerant circulating system, a second cold source which is in heat-exchanging relationship with the cooling fluid circulating system and which comprises a second refrigerant circulating system, and a means for selectively operating one of the circulating systems, for the fountain fluid or the cooling fluid, or both of these circulating systems, wherein the condenser means of the first cold source is in heat-exchanging relationship with the second refrigerant circulating system of the second cold source.

2. Assembly in accordance with claim 1, wherein the second cold source is an external cold source.

3. Assembly in accordance with claim 1, wherein the second refrigerant circulating system of the second cold source comprises parallel supply lines for supplying the second refrigerant for heat-exchange with the cooling fluid circulating system of the drum cooling means or the condenser means of the first cold source.

* * * * *